US005607057A

United States Patent [19]

Eches et al.

[11] Patent Number: 5,607,057

[45] Date of Patent: Mar. 4, 1997

[54] DEVICE FOR JOINING PROPELLANT CHARGE CONTAINERS AND CONTAINER HAVING SUCH A DEVICE

[75] Inventors: Nicolas Eches, Bourges; Yves Cappy, Saint Denis de Palin, both of France

[73] Assignee: Giat Industries, Versailles, France

[21] Appl. No.: 489,131

[22] Filed: Jun. 9, 1995

[30] Foreign Application Priority Data

Jun. 16, 1994 [FR] France ..... 94 07352

[51] Int. Cl.[6] ..... F42B 5/00

[52] U.S. Cl. ..... 206/509; 220/4.27; 102/282

[58] Field of Search ..... 206/509; 220/4.27, 220/23.4, 4.26; 102/282

[56] References Cited

U.S. PATENT DOCUMENTS

| | | | |
|---|---|---|---|
| 861,815 | 7/1907 | Cullen | 220/4.27 |
| 2,553,559 | 5/1951 | Eckman | 220/4.27 X |
| 2,663,450 | 12/1953 | Bourcart | 220/4.27 X |
| 3,176,617 | 4/1965 | Brafford | 102/282 |
| 3,376,816 | 4/1968 | Foster et al. | 220/4.27 X |
| 3,395,642 | 8/1968 | Foster et al. | 220/4.27 X |
| 4,485,923 | 12/1984 | Schwaikert | 206/509 X |
| 5,090,323 | 2/1992 | Kallevig et al. | 102/282 |
| 5,282,423 | 2/1994 | Sikorski et al. | 102/282 X |

FOREIGN PATENT DOCUMENTS

| | | |
|---|---|---|
| 1291315 | 3/1962 | France . |
| 2210869 | 3/1972 | Germany . |
| 613586 | 11/1948 | United Kingdom . |

*Primary Examiner*—Steven M. Pollard
*Attorney, Agent, or Firm*—Oliff & Berridge

[57] ABSTRACT

A device for joining a first container to a second container to be inserted into the chamber of a weapon includes a first neck disposed adjacent a first face of the first container, a second neck disposed adjacent a second face of the second container and a deformable ring. The first container and the second container have container diameters that are less than a chamber diameter D1. The first face of the first container is alignable with a second face of the second container along a longitudinal axis. The second neck includes a circular cusp. The deformable ring is disposed around the first neck and includes an annular lip. The deformable ring is shaped to slide substantially parallel to the longitudinal axis toward the second container to engage the cusp. The deformable ring has a ring diameter D3 that is greater than the chamber diameter D1. The deformable ring is configured to decrease in diameter under deformation from the ring diameter D3 to the chamber diameter D1 when the first container is inserted into the chamber. As a result, the deformable ring disengages from the cusp and allows the first container to separate from the second container without requiring use of tools or manipulation by the operator.

20 Claims, 7 Drawing Sheets

DEVICE FOR JOINING PROPELLANT CHARGE CONTAINERS AND CONTAINER HAVING SUCH A DEVICE

BACKGROUND OF THE INVENTION

1. Field of the Invention

The field of the invention is containers able to accommodate a propelling charge and, more particularly, containers used in the field of large caliber or tank artillery.

2. Background of Related Art

So as to adjust the firing range, it is often necessary to modify the amount of powder which is used to launch a projectile.

Approximately cylindrical containers made of a combustible material are known. Because these containers are rigid, they are easier to use that the traditional bags of powder.

So as to reduce the amount of space taken up inside armored vehicles, it may also be necessary to divide each container into two separate parts, one part carrying the main propelling charge and the other the projectile and possibly a second propelling charge (as described, for example, in British Patent GB 2136929).

The time required for loading can be decreased by introducing all the containers in a single operation, for example, by using an automatic loading device.

It is critical in this event to ensure that the containers are joined to ensure a certain rigidity of the overall assembly.

Moreover, it may prove necessary to rapidly withdraw the charge already introduced in the weapon chamber, and this withdrawal operation consumes more time and is more difficult if the whole charge is divided into several loads.

French Patent FR9101499 discloses a linking device for containers that includes a sliding ring and a self-gripping device arranged on the front face of the container.

Such a device, however, is complicated and costly to manufacture.

Moreover, it may or may not be necessary, according to operational needs, to join the containers. However, the device disclosed in French Patent FR9101499 does not permit such a choice because the axial link cannot be disassembled quickly.

It may also be necessary to quickly withdraw the containers from the chamber to replace the container carrying the priming system (for example, in the event that the priming system fails). The containers must therefore be easy to separate.

In addition, the disclosed device is difficult to implement. To use the ring, the two containers must be correctly positioned radially. However, the fastening device is operational irrespective of the relative radial position of the containers. As a consequence, the two containers are difficult to align and it is therefore difficult to join them.

French Patent FR1291315 discloses a disconnectable coupling for explosive cartridges in which the cartridges are separated by actuating a wire or a cord that enables an internal flexible ring to be compressed manually.

Such a device is not satisfactory from an operational point of view because the separation of the cartridges requires an extra element outside the cartridge (i.e., the wire or cord). Moreover, such a separation is rather slow.

SUMMARY OF THE INVENTION

An aim of the present invention is to provide a linking device for containers that overcomes the disadvantages of the prior art.

The linking device provides an easy link between two containers before they are inserted into the chamber of a weapon and the quick separation of the containers without using an extra element when it is necessary to remove them from the chamber.

A further aim of the invention is a container that may be joined with another container by one of its end faces by such a linking device.

The invention may be applied to the manufacture of modular charges as well as to charges having at least two loads, one carrying the main charge and its primer tube and the other the projectile (and possibly, but not necessarily, a secondary charge).

The device for joining includes a ring mounted to slide on a first neck of a first container to partially cover a second neck of second container, the front end of the ring having a ring-shaped lip that ensures the axial hooking of the ring on the second container when the ring covers the second neck. The lip cooperates with a circular cusp on a ring formed in the second neck. The device includes structure to ensure the disengagement of the front end of the ring from the second container when the two containers are positioned in the chamber of a weapon. One such structural feature is that an external diameter of the ring is greater than the diameters of a barrel and of the container, the ring being deformed radially when the containers are positioned in the chamber so that the ring diameter becomes approximately equal to that of the container. The deformation causes the ring-shaped lip of the ring to become disengaged from the circular cusp of the ring of the second container when the two containers are positioned in the weapon chamber.

The device includes a second structural feature to ensure the engagement an inner part of the ring with the second container when the two containers are in the weapon chamber.

The second structural feature of the inner part of the ring preferably includes a projection on the inner surface of the ring to abut a collar on the ring disposed around the second neck.

The ring can include a shoulder designed to cooperate with a flange fitted on the first neck to provide an axial stop. The shoulder is made of plastic, preferably polyoxymethylene, high density polyethylene or polyamide.

The flange can be formed as a single part with a sleeve that surrounds the first neck. The ring is disposed to slide over the sleeve.

The sleeve and/or the ring can be made of plastic, preferably high density polyethylene or polyamide.

According to a second embodiment, the sleeve includes a ring-shaped stop that engages the ring with the sleeve in forward position of the ring, the shoulder of the ring being positioned between the stop and the ring-shaped flange.

As an alternative, the projection and the collar can each include a tapered seat, the two tapered seats matching and being designed to cooperate with each other.

A further aim of the invention is providing a container designed to be joined with a second container by one of its end faces with a linking device. The container includes at least one neck disposed near the first face. The neck is designed to accommodate a ring having an external diameter greater than the external diameter of the container or chamber which deforms radially thereby decreasing to approximately the diameter of the container, the ring being mounted to slide on the neck. In addition, the front end of the ring includes a ring-shaped lip designed to cooperate with a circular cusp arranged on a ring on a second neck.

The first neck includes a sleeve designed to accommodate the ring, the sleeve having a ring-shaped flange designed to cooperate with a shoulder of the ring.

According to another characteristic, the container includes at least one neck arranged near the first face, the neck having a ring with a circular cusp designed to cooperate with a ring-shaped lip arranged on a ring of the second container.

BRIEF DESCRIPTION THE DRAWING

The invention will be made clearer after reading the description of the particular embodiments, the description being made with reference to the appended drawings in which.

DETAILED DESCRIPTION OF PREFERRED EMBODIMENTS

Figure 1:
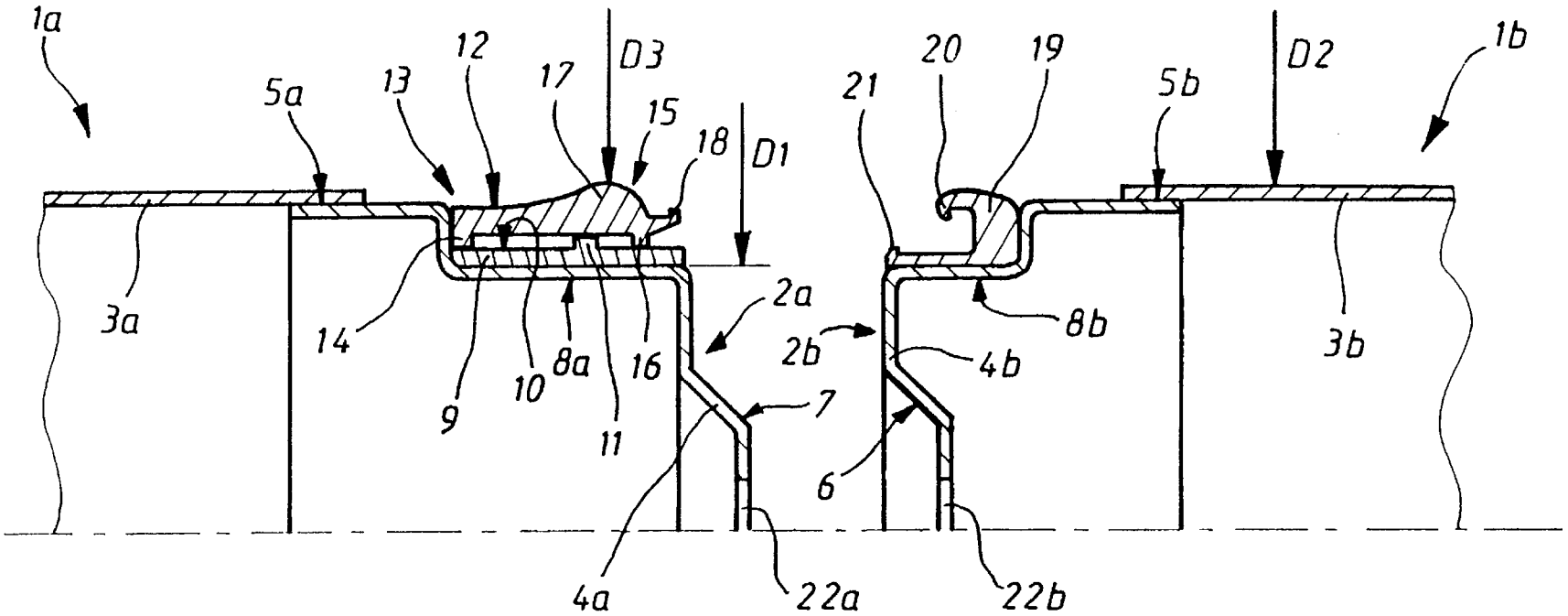
FIG. 1 shows a partial cross-section of two containers before assembly according to a first embodiment of the invention.

With reference to FIG. 1, a first face 2*a* of a first container 1*a* is designed to be joined to a second face 2*b* of a second container 1*b*.

Each container includes a cylindrical outer surface 3*a*,3*b* made of a combustible material such as nitrocellulose, cardboard or a mixture of cardboard and nitrocellulose.

The outer surfaces are closed off by end plugs 4*a*,4*b* that are also made of a combustible material. The plugs are attached to outer surfaces, e.g., by bonding them adjacent cylindrical supports 5*a*,5*b*.

The containers 1*a* and 1*b* are shown partially in this example. They are designed to accommodate a propelling charge of grains or sticks (not shown).

The container 1*b* includes a projectile (not shown) attached to its first face that can be joined with the outer surface 3*b* by a linking ring (for example, similar to the linking ring disclosed in French Patent FP8712484).

The container 1*a* includes a munition base (not shown) attached to its other end that is fitted with a primer tube (see, for example, French Patent FR9101499, which shows a fastening device for such a base).

The projectile may also be fastened onto container 1*a* and the base onto container 1*b*.

A plug 4*b* has a recessed part 6 having a tapered profile that is positioned in the center of the first face 2*b*.

A plug 4*a* has a protruding part 7 having a tapered profile that is positioned in the center of the first face 2*a*.

The tapered profiles of the recessed part 6 and the protruding part 7 match and are designed to cooperate with each other to provide a relative radial positioning (i.e., axial alignment along a longitudinal axis) of the two containers before assembly.

Axial openings 22*a* and 22*b* are arranged on the first face 2*a* and the second face 2*b* of the containers. These openings facilitate the transmission of a flame from one container to another during firing of the propelling charge. They are obstructed in a known way by means of combustible foils (not shown).

The end plugs 4*a* and 4*b* each have a neck 8*a*,8*b* having a maximum diameter D1 of about 10 mm less than the external diameter D2 of the container, the diameter D2 of the container being approximately the same as the inner diameter of the chamber of a weapon in which it will be installed.

The neck 8*a* of the container 1*a* is fitted with an sleeve 9 fastened, for example, by bonding. The sleeve 9 is made of plastic, for example, polyoxymethylene, high density polyethylene or polyamide.

The sleeve 9 is fitted with a ring-shaped flange 11 on its outer cylindrical surface 10.

A ring 12 is mounted to slide on the sleeve 9. The ring 12 is also made of plastic, for example, polyoxymethylene, high density polyethylene or polyamide. The ring includes a shoulder 14 arranged on a rear part 13 and a projection 16 on an inner surface adjacent a front end 15.

The shoulder 14 and the projection 16 are dimensioned to slide over the sleeve 9.

The shoulder 14 is designed to abut the ring-shaped flange 11 to reduce the axial movement of the ring 12 with respect to the sleeve 9. During assembly, the ring 12 is put in place by forcing it over the sleeve 9 before the sleeve 9 is bonded onto the first neck 8*a*. Thus, the ring 12 can no longer be separated from the container 1*a*, thereby minimizing the chance of losing the ring. So as to facilitate the positioning of the ring on the sleeve, an assembly chamfer may be provided on the rear face on the shoulder 14 of the ring and on the front face of the ring-shaped flange 11 of the sleeve.

The ring 12 includes an outer rib 17 having a diameter D3 greater than the diameter D2 of the container by about 2 to 3 mm.

The ring also includes, on its front end 15, a ring-shaped lip 18.

The container 1*b* includes a ring 19 fastened to the second neck 8*b*, for example, by bonding. The ring 19 is also made of plastic, for example, high density polyethylene or polyamide.

The ring 19 has a circular cusp 20 designed to cooperate with the ring-shaped lip 18 of the ring 12. The ring 19 also includes a collar 21 designed to cooperate with the projection 16 of the ring 12.

Figure 2:
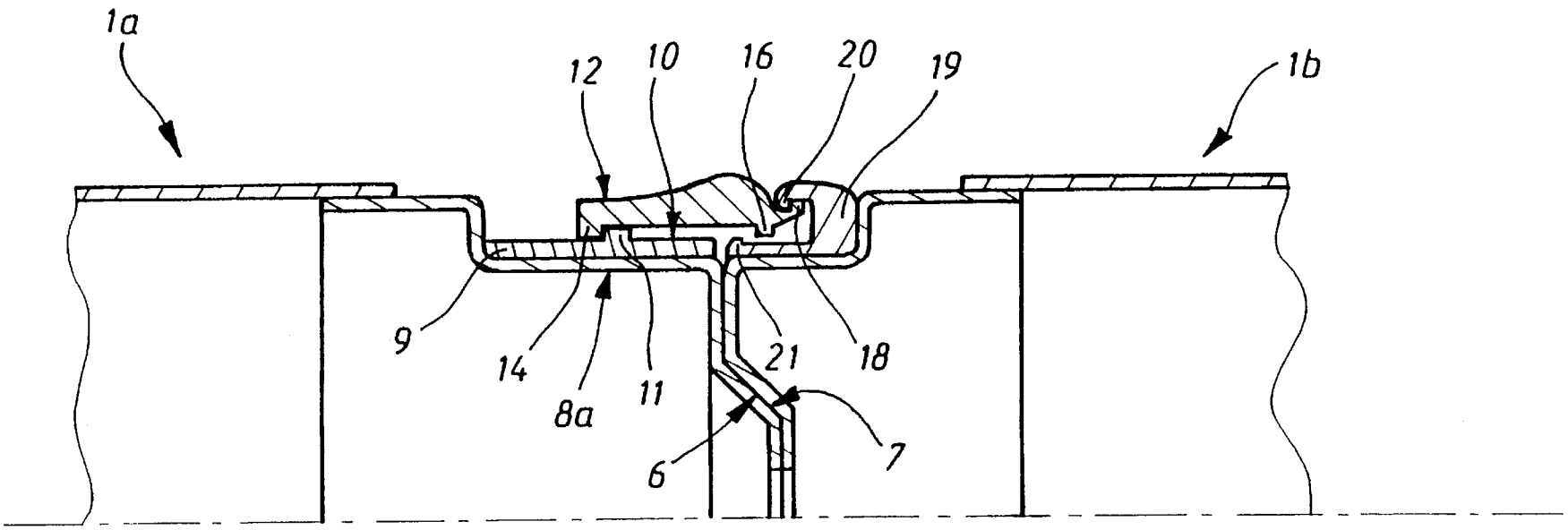
FIG. 2 shows a partial cross-section of the two containers of FIG. 1 after they have been joined.

FIG. 2 shows the two containers 1*a* and 1*b* assembled with the ring 12.

The two containers have been joined with each other by bringing the first face 2*a* into contact with the second face 2*b*. The recessed part 6 and the protruding part 7 ensure that the containers are in axial alignment along the longitudinal axis with each other, thereby ensuring the correct radial positioning of the two containers.

Once the two containers have been positioned with respect to one another, the ring 12 is slid over the sleeve 9 to bring it into contact with the ring 19. A slight pressure enables the ring-shaped lip 18 to engage the circular cusp 20, thereby joining the two containers.

The shoulder 14 of the ring 12 abuts against the ring-shaped flange 11 of the sleeve 9. The flange 11 thereby ensures the axial immobilization of the containers 1*a* and 1*b* when the lip 18 of the ring 12 is engaged by the circular cusp 20 of the ring 19.

The sizes of the ring 12, the sleeve 9 and the ring 19 are determined such that axial immobilization may be achieved. Thus, when the containers are joined with each other and the lip 18 is engaged with the cusp 20, the shoulder 14 is abutted against the flange 11.

The collar 21 has an external diameter which is substantially less than the external diameter 10 of the sleeve 9 so as not to interfere with the projection 16 during the translational movement of the ring 12.

The material of the ring 12, the sleeve 9 and the ring 19 fragments during the initiation of the propelling charge under the action of the gas pressure. So as to facilitate this fragmentation, incipient fractures may be provided, for example, by spot heating or machining.

Figure 3:
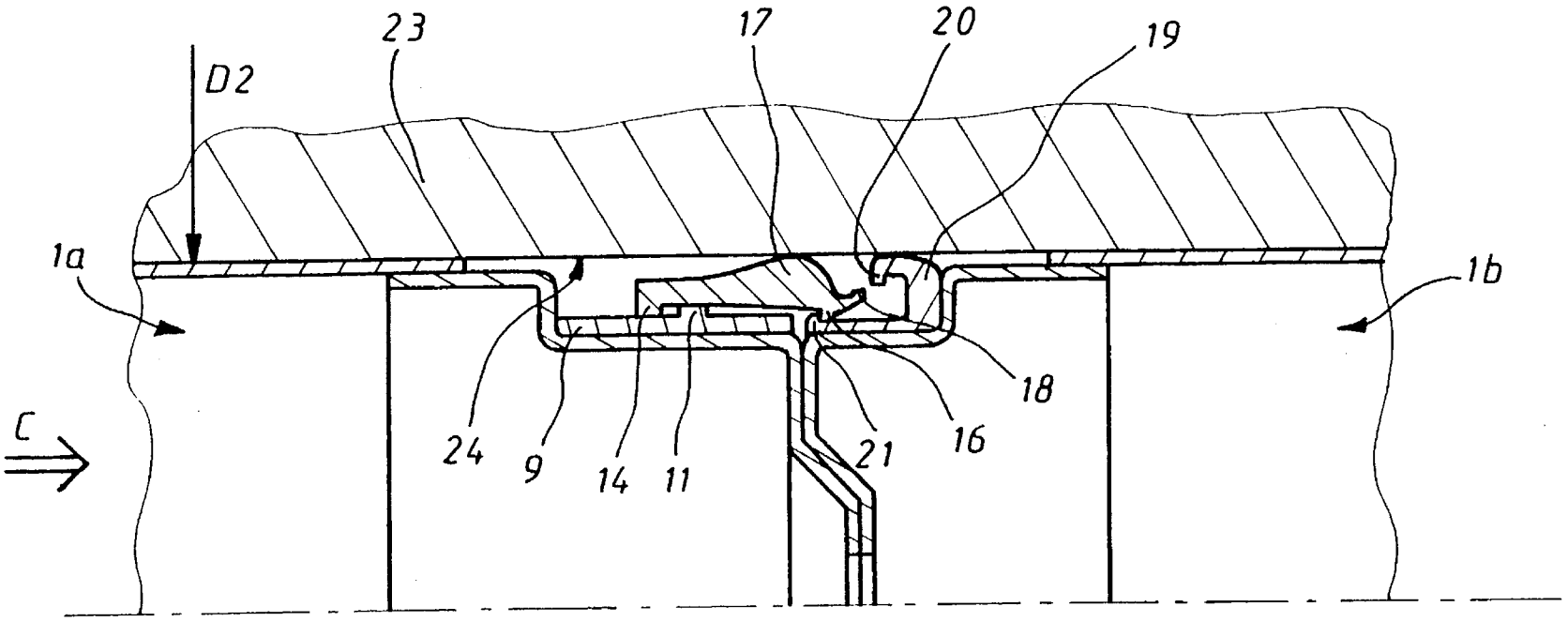
FIG. 3 shows a partial cross-section of the two containers of FIG. 2 after they have been positioned inside the barrel of a weapon.

The use of plastic materials for the manufacture of the ring 12, the sleeve 9 and the ring 19 enable containers to be designed with an extremely rigid link. FIG. 3 shows the two containers 1*a* and 1*b* joined by the ring 12 and installed inside the barrel 23 of a weapon.

When the two containers 1*a* and 1*b* are loaded into the chamber 24 of the barrel 23 in the direction of arrow C, the ring 12, which is in its initial position has a diameter D3 greater than the diameter D2 of the containers, deforms radially in a flexible manner, thereby decreasing in diameter to the diameter D1 of the chamber 24.

The deformation of the ring causes the lip 18 to become disengaged from the circular cusp 20 and to move slightly backward towards the first container until the projection 16 abuts against the collar 21.

The dimensions of the ring are determined such that the deformation of the ring by the reduction of its external diameter D3 ensures the release of the lip 18 from the cusp 20 and the backward movement of the projection 16 against the collar 21.

Figure 4:
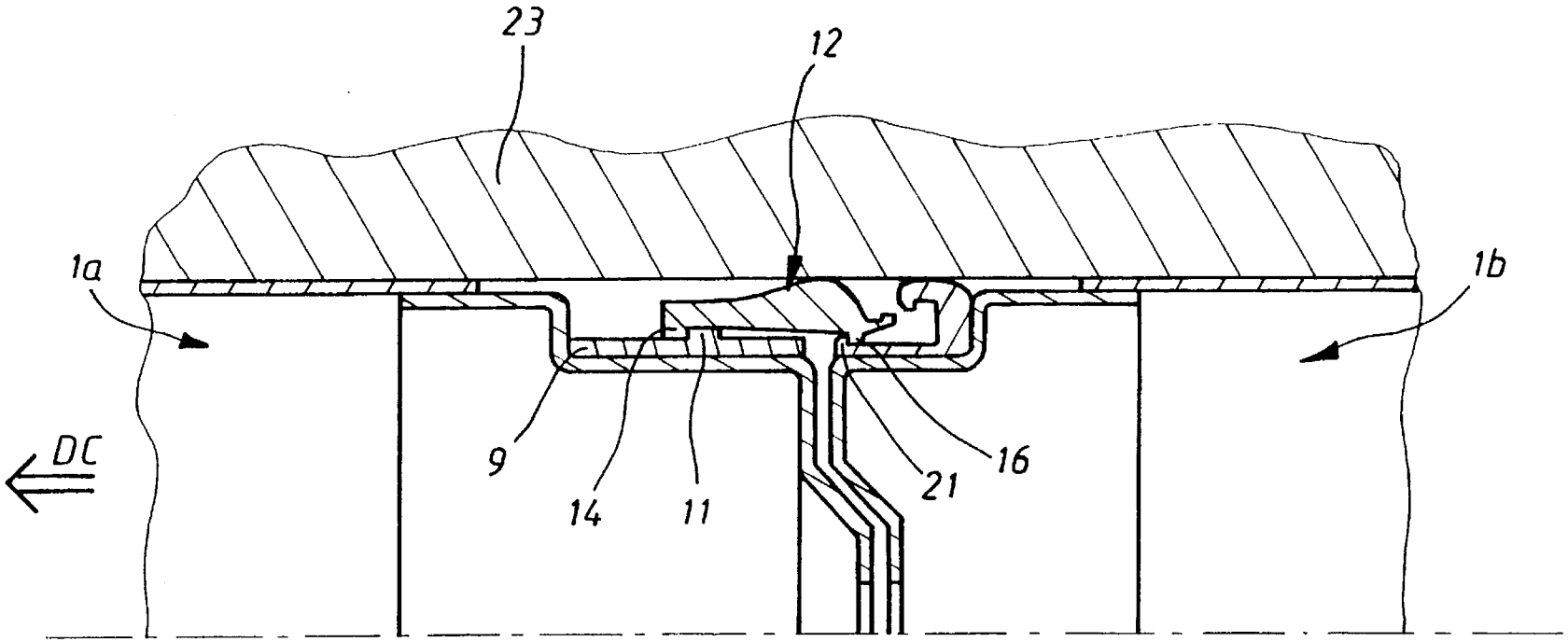
FIG. 4 shows a partial cross-section of the two containers of FIG. 3 being unloaded from the barrel of a weapon.

FIG. 4 shows the two containers 1*a* and 1*b* during the unloading phase.

The charge already introduced into the chamber of the weapon may have to be quickly withdrawn. Withdrawal is carried out as follows:

the container 1*a* is removed in the direction of the arrow DC, which brings the flange 11 of the sleeve 9 into contact against the shoulder 21 of the ring 19; the container 1*b* is thereby joined and is drawn along with the container 1*a*.

The two containers may thus be removed in a single operation.

Figure 5:
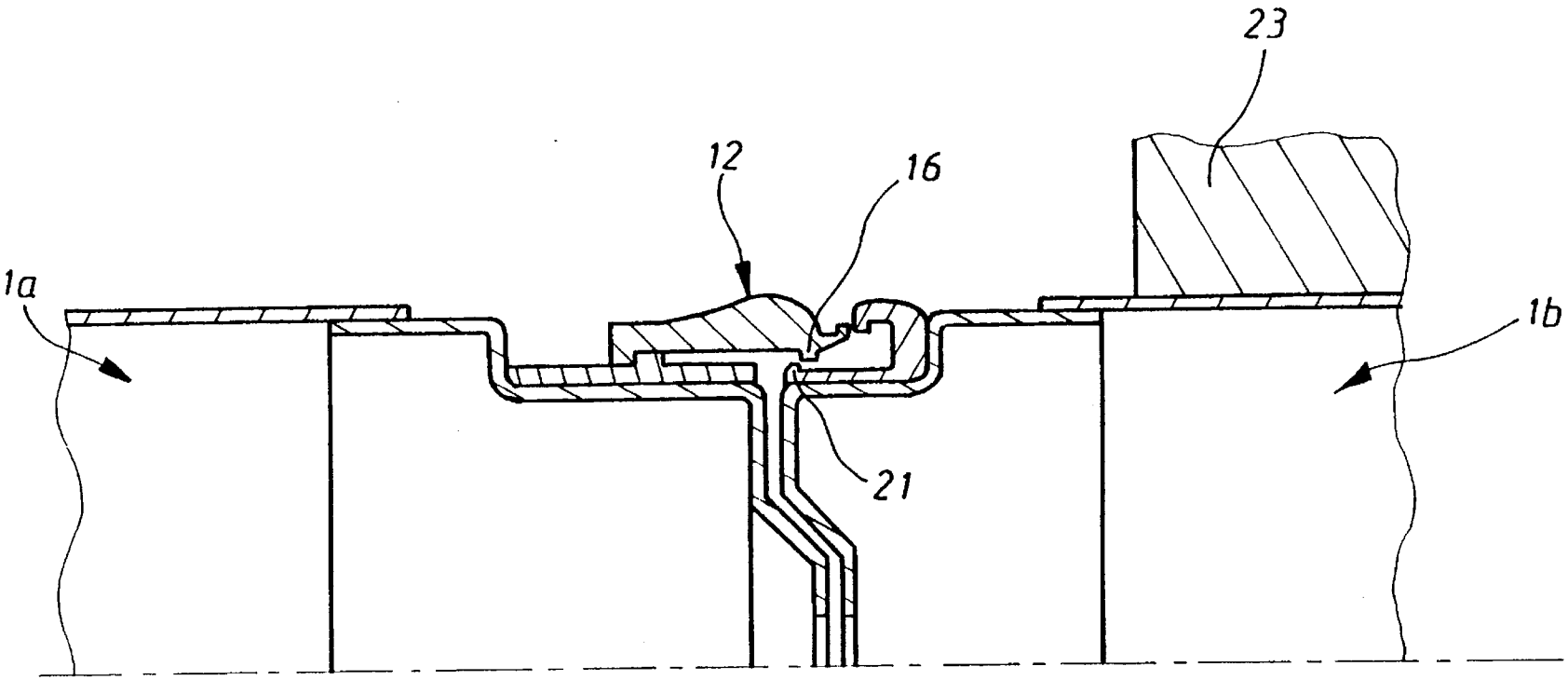
FIG. 5 shows a partial cross-section of the two containers of FIG. 4 at the end of the unloading phase.

FIG. 5 shows the two containers 1*a* and 1*b* at the end of the unloading phase.

Upon exiting from the barrel 23, when the container 1*a* is lifted, the container 1*b* continues its movement towards the container 1*a* through its own inertia, thereby releasing the ring 12, which returns to its initial high position because of its residual flexibility and releases the projection 16 from the collar 21. This enables the automatic separation of the two containers without requiring any manual intervention.

The two containers are thus removed from the chamber of the barrel of the weapon, which enables a quicker maneuver, for example, in the event that only one of the containers is required or that the restocking of containers that have not been used is taking place.

Figure 6:
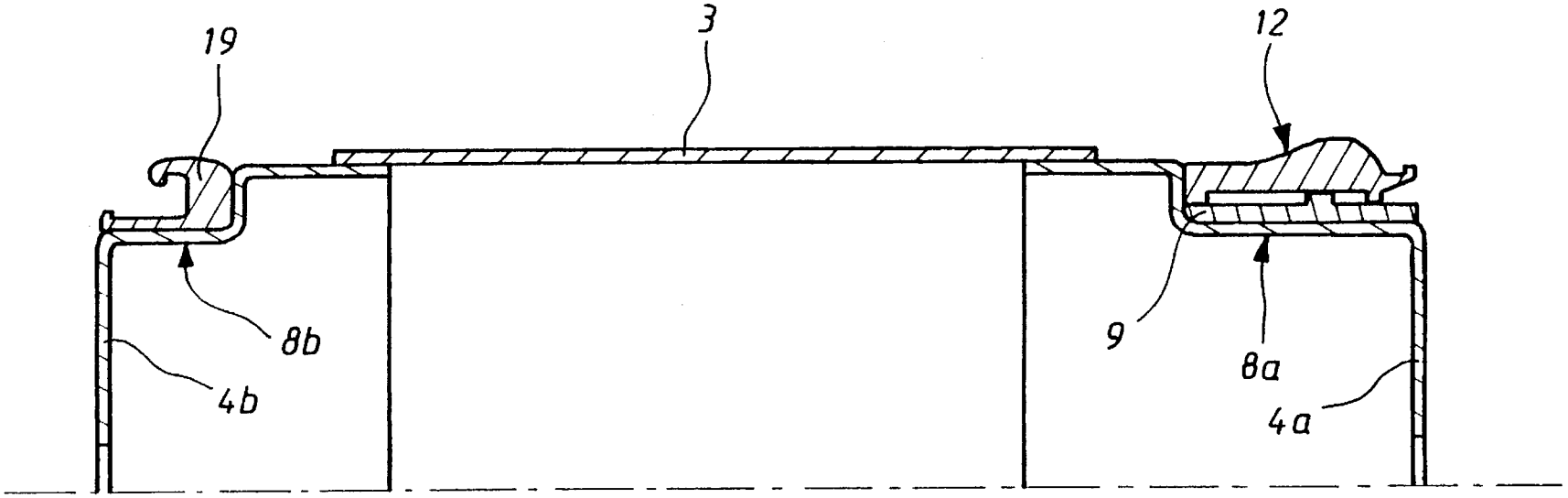
FIG. 6 shows a modular type container according to the invention.

FIG. 6 shows a modular type container according to the invention. This container, which is made of a combustible material, is designed to be assembled with other containers that are substantially identical to it so as to constitute a propelling load for artillery.

The container includes a combustible outer surface 3, closed off at one end by a plug 4*a* that includes a first neck 8*a* and at the other end by a plug 4*b* that includes a second neck 8*b*.

The first neck 8*a* carries a sleeve 9 and a ring 12. The second neck 8*b* includes a ring 19.

Of course, a modular container may be designed in which the end faces have radial positioning devices including, e.g., a recessed part or a protruding part.

The outer surface in this event would be closed off at its ends by plugs 4*a*, 4*b* of the type shown in FIG. 1.

In the embodiment of the containers described above, the cylindrical outer surface was closed by two combustible plugs having a neck. In an alternative embodiment, at least one plug may be formed as a single part with the outer surface. In order to achieve this feature, the outer surface is shaped in a suitable mold. The difficult operation of fastening the plug on the outer surface by bonding is thereby avoided.

The plugs may also be made of a plastic material and may be formed as a single part with the ring and the sleeve. The alternative structures are similar to the structures depicted in FIGS. 1–6.

So as to facilitate the fragmentation of such plugs made of plastic material, incipient fractures may be provided on the plugs, for example, by spot heating or by machining.

Figure 7:
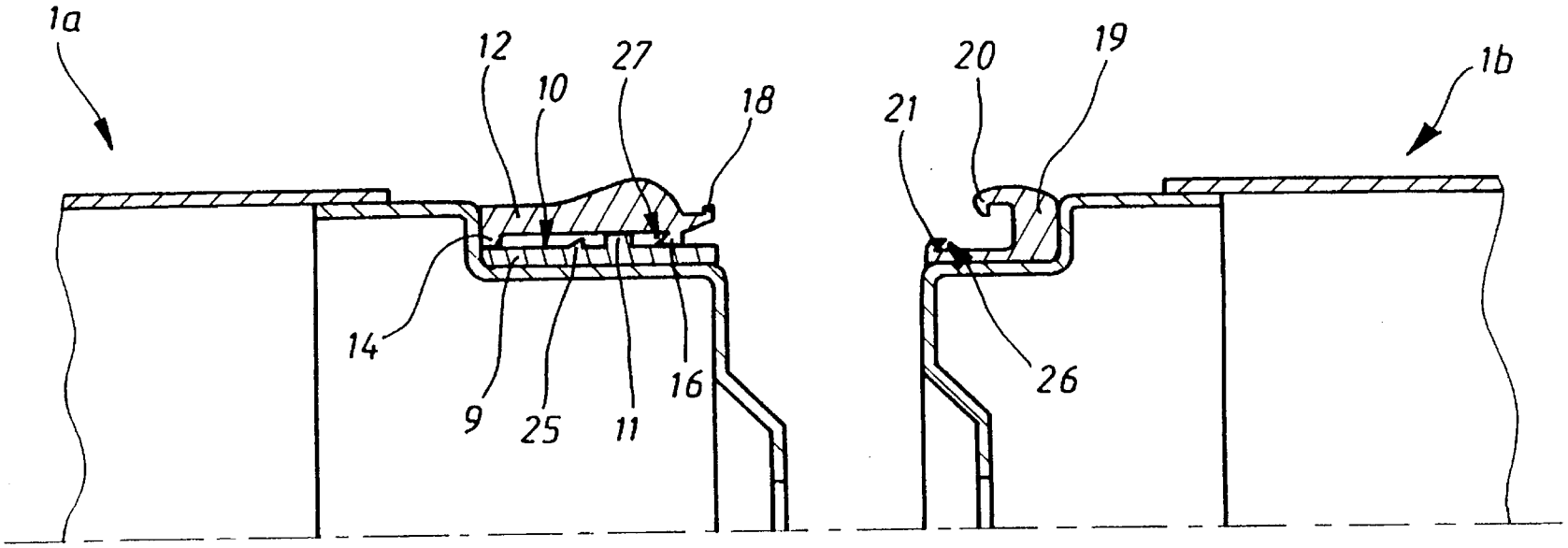
FIG. 7 shows a partial cross-section of two containers before assembly according to a second embodiment of the invention.

FIG. 7 shows two containers according to a second embodiment.

In this embodiment, the sleeve 9 has a ring-shaped stop 25 on its outer cylindrical surface 10 near the flange 11.

The stop 25 holds the ring 12 when the ring is in its forward position, the shoulder 14 of the ring being secured between the flange 11 and the stop 25.

The stop 25 has a chamfer on its rear part which facilitates the ring 12 in passing over the stop 25. The ring may also be provided with a matching chamfer (not shown) on the front part of the shoulder 14.

Such an embodiment has the advantage of being able to be used in an automatic loading device without requiring the prior assembly of the two containers, the only required operation being that of moving the ring 12 to its forward position. Once the ring is in its forward position, the container 1*a* is installed in the automatic loader followed by the container 1*b*. The ring 12 cannot move backwards because of the stop 25, so the container 1*b* is automatically joined with the container 1*a* by engagement between the lip 18 of the ring 12 and the cusp 20 of the ring 19.

The collar 21 of the ring 9 has, in this second embodiment, a tapered seat 26 matching a tapered seat 27 rearward of the projection 16 of the ring 12.

The two matching tapered seats 2 and 27 improve the mechanical strength of the link during withdrawal of the containers.

Alternatively, the first embodiment can include a collar 21 and a projection 16 having matching tapered seats 26,27, and the second embodiment need not include such tapered seats.

What is claimed is:

1. A device for joining a first container to a second container to be inserted into the chamber of a weapon, said chamber having a chamber diameter D1 and said first container and said second container having container diameters that are less than said chamber diameter D1, a first face of said first container being alignable with a second face of said second container along a longitudinal axis, said device comprising:

a first neck disposed adjacent said first face of said first container;

a second neck disposed adjacent said second face of said second container, said second neck having a circular cusp; and a deformable ring disposed around said first neck and having an annular lip, said deformable ring being shaped to slide substantially parallel to said longitudinal axis toward said second container to engage said cusp, said deformable ring having a ring diameter D3 greater than said chamber diameter D1, wherein said ring diameter D3 is configured to decrease under deformation to said chamber diameter D1 when said first container is inserted into said chamber, thereby disengaging said deformable ring from said cusp and allowing said first container to separate from said second container.

2. The device of claim 1, wherein said deformable ring includes a lip, and wherein said second neck includes a collar, said lip engaging said collar when said deformable ring is slid to join said first container to said second container.

3. The device of claim 1, wherein said lip includes a first slanted surface and said collar includes a second slanted surface, said first slanted surface engaging said second slanted surface when said first container is joined with said second container.

4. The device of claim 1, wherein said first neck includes a shoulder and said deformable ring includes a flange, said shoulder engaging said flange to maintain said sleeve in contact with said first container when said deformable ring is slid toward said second container to join said first container and said second container.

5. The device of claim 4, wherein said first neck includes an annular stop disposed to engage a rear part of said shoulder when a forward part of said shoulder engages said flange.

6. The device of claim 4, wherein said flange is formed as a single piece with a sleeve disposed around said first neck and underneath said deformable ring.

7. The device of claim 6, wherein said sleeve is made of one of polyoxymethylene, high density polyethylene and polyamide.

8. The device of claim 1, wherein said ring is made of one of polyoxymethylene, high density polyethylene and polyamide.

9. A device for joining a first container to a second container to be inserted into the chamber of a weapon, said chamber having a chamber diameter D1 and said first container and said second container having container diameters less than said chamber diameter D1, a first face of said first container being alignable with a second face of said second container along a longitudinal axis, said device comprising:

a first neck disposed adjacent said first face of said first container;

a second neck disposed adjacent said second face of said second container, said second neck having an engagement portion;

a deformable ring disposed around said first neck to join said first container and said second container, said ring having a ring diameter D3 greater than said chamber diameter D1; and first engagement means for engaging said deformable ring with said engagement portion, wherein said ring diameter D3 is configured to decrease under deformation to said chamber diameter D1 when said first container is inserted into said chamber, thereby disengaging said first engagement means and said engagement portion and allowing said first container to separate from said second container.

10. The device of claim 9, wherein said engagement portion includes a cusp disposed on said second neck and said first engagement means includes an annular lip shaped to engage said cusp.

11. The device of claim 9, further comprising second engagement means for engaging said deformable ring with said engagement portion, said second engagement means being engageable with a second engagement portion of said second container.

12. The device of claim 11, wherein said second engagement means includes a first slanted surface disposed on said deformable ring and said second engagement portion includes a second slanted surface disposed to engage said first slanted surface.

13. A container joinable to other containers for insertion into the chamber of a weapon, said chamber having a chamber diameter D1 and said container having a container diameter less than said chamber diameter D1, said container having a first face aligned with a second face along a longitudinal axis, said device comprising:

a first neck disposed adjacent at least said first face of said container;

a second neck disposed adjacent at least a second face of a first of said other containers, said second neck having a circular cusp; and a deformable ring disposed around said first neck and having an annular lip, said deformable ring being shaped to slide substantially parallel to said longitudinal axis toward said second container to engage said cusp, said deformable ring having a ring diameter D3 greater than said chamber diameter D1, wherein said ring diameter D3 is configured to decrease under deformation to said chamber diameter D1 when said container is inserted into said chamber, thereby disengaging said deformable ring from said cusp and allowing said container to separate from said first of said other containers.

14. The container of claim 13, wherein said deformable ring includes a lip, and wherein said second neck includes a collar, said lip engaging said collar when said deformable ring is slid to join said container and said other containers to said first of said other containers.

15. The container of claim 13, wherein said lip includes a first slanted surface and said collar includes a second slanted surface, said first slanted surface engaging said second slanted surface when said deformable ring is slid to join said container to said first of said other containers.

16. The container of claim 13, wherein said first neck includes a shoulder and said deformable ring includes a flange, said shoulder engaging said flange to maintain said sleeve in contact with said container when said deformable ring is slid toward said first of said other containers to join said container and said first of said other containers.

17. The container of claim 16, wherein said first neck includes an annular stop disposed to engage a rear part of said shoulder when a forward part of said shoulder engages said flange.

18. The container of claim 16, wherein said flange is formed as a single piece with a sleeve disposed around said first neck and underneath said deformable ring.

19. The container of claim 18, wherein said sleeve is made of one of polyoxymethylene, high density polyethylene and polyamide.

20. The container of claim 13, wherein said deformable ring is made of one of polyoxymethylene, high density polyethylene and polyamide.

* * * * *